US005804303A

United States Patent [19]

Lorenz et al.

[11] Patent Number: 5,804,303

[45] Date of Patent: Sep. 8, 1998

[54] TOW OF MELT-SPUN FILAMENTS

[75] Inventors: Jürgen Lorenz, Berlin; Axel Vischer, Augsburg, both of Germany

[73] Assignee: Hoechst Trevira GmbH & Co. KG, Germany

[21] Appl. No.: 826,270

[22] Filed: Mar. 27, 1997

Related U.S. Application Data

[62] Division of Ser. No. 657,804, May 31, 1996, Pat. No. 5,679,300.

[30] Foreign Application Priority Data

May 31, 1995 [DE] Germany ..... 195 19 882.4

[51] Int. Cl.[6] ..... D02G 3/00

[52] U.S. Cl. ..... 428/357; 428/362

[58] Field of Search ..... 428/357, 364, 428/394, 362

[56] References Cited

U.S. PATENT DOCUMENTS 3,177,555 4/1965 Clapp et al. .

5,063,945 11/1991 Sugihara et al. ..... 428/394

5,105,513 4/1992 Marx et al. ..... 28/264

*Primary Examiner*—Newton Edwards

*Attorney, Agent, or Firm*—Connolly & Hutz

[57] ABSTRACT

A tow of melt spun filaments and a method for treating such filaments to produce a tow of uniformly crimped filaments having a high initial modulus by heat setting and stuffer box crimping includes the steps of heat-setting the tow, spraying the hot-heat-set tow with an aqueous fiber finish to effect shocklike cooling of the tow, passing the sprayed tow to a pair of squeeze rolls in whose nip it is kneaded through using a defined nip pressure and squeezed off to a fiber finish pickup of 0.7 to 7% by weight of the tow weight, heating the squeezed-off moist tow on a heated multiroll arrangement in such a way that it leaves the multiroll arrangement with a moisture content of 0.5 to 5% by weight of the tow weight and a temperature of 40° to 1000° C., feeding the tow with this moisture content and this temperature to a crimping machine and crimping it.

1 Claim, No Drawings

TOW OF MELT-SPUN FILAMENTS

CROSS-REFERENCE TO RELATED APPLICATION

The present application is a divisional of application Ser. No. 08/657,804, filed May 31, 1996, now U.S. Pat. No. 5,679,300.

BACKGROUND OF THE INVENTION

The present invention relates to a method for treating a tow of synthetic filaments wherein the tow is heat-set under certain conditions, afterfinished with an excess of fiber finish, subjected to a defined heat treatment and then crimped. The treatment leads to an improvement in the uniformity of crimp while minimizing fiber damage and also to the attainment of a high initial modulus and a reduction in the oligomer content of the fiber.

The postdraw finishing of tow by means of application rolls is known. Similarly, it is known to apply a fiber finish from a swellbath. The squeezing off of excess finish using rubberized rolls at the inlet to fiber bundle production lines is likewise known.

DE-C-22 22 358 discloses an apparatus for wet-treating (washing) and stretching a filament tow, consisting of a plurality of successive pairs of superposed rolls, together forming a stretch unit, which are meanderingly circumnavigated by the tow. At least some of the bottom rolls of the pairs of rolls are assigned squeeze rolls, and above the top rolls are liquid supply means which moisten the tow passing over the roll by spraying water onto it.

DE-A-29 33 235 discloses a process for crimping a water- and solvent-containing tow, for example a tow of wet-spun PAN filaments, wherein the tow before entry into the crimper passes through a pair of precision squeeze rolls where it is squeezed off under a certain nip pressure, preferably to a water content of 30–35% by weight. The solvent-containing water squeezed out in the squeezed rolls is recycled into the last wash bath, and the solvent-containing water squeezed out in the course of crimping is recycled back into the crimp box.

U.S. Pat. No. 3,177,555 describes a filament tow treatment process consisting of stretching, hot-air setting and crimping, wherein a fiber finish is sprayed onto the tow between setting and crimping.

The amount of fiber finish sprayed on to the tow is such that the tow becomes saturated with the fiber finish.

DE-A-22 46 604 discloses a process for the uniform drawing of tows of polyethylene terephthalate filaments, wherein the tow is drawn in a draw roll system while being sprayed initially with hot water, then with cold water and finally with an aqueous fiber finish while in contact with the rolls. The maximum draw ratio is determined by a mathematical function of the temperature of the hot water and the intrinsic viscosity of the filament material.

The filaments thus produced have a high uniformity of draw and a high initial shrinkage of >5%, preferably above 9%.

DE-A-40 06 398 discloses a process for application of a finish or lubricant in the production of synthetic fiber, wherein filament bundles are guided without room for evasion and with fanning out into individual filaments while being sprayed with the precisely metered finish or lubricant liquid; the filament bands are intended to act like the filter packets of an aerosol separator.

U.S. Pat. No. 4,642,860 discloses a process for crimping synthetic fiber in a stuffer box, wherein a filament tow is pressed by intake rolls into the stuffer box and the tow and the intake rolls are sprayed with an atomized lubricating finish in the region of the roll nip.

It is true that all the processes mentioned have specific technical advantages or confer qualitative benefits on the fiber materials produced. However, these advantages come with disadvantages in respect of other process and product properties: more particularly, the prior art does not indicate any way of at one and the same time

- improving the uniformity of crimp while minimizing fiber damage,
- attaining a high and extremely uniform initial modulus, and
- significantly reducing the oligomer content of the fiber.

DETAILED DESCRIPTION OF THE INVENTION

It has now been found that these desirable fiber properties can be achieved while additionally minimizing the thermal stress on the fiber finish and realizing a greater tolerance in respect of the fiber-finish add-on level if a tow of synthetic filaments is subjected to a defined heat-setting and crimping treatment described hereinafter.

One aspect of the present invention is accordingly a method for treating a tow of synthetic filaments, which comprises

- heat-setting the tow at a temperature of 140° to 190° C., preferably 150° to 170° C., for example 160°–162° C.,
- spraying the hot heat-set tow at from 140° to 190° C. with an aqueous fiber finish in an amount of 50 to 200% by weight of the saturation amount to effect shocklike cooling of the tow,
- passing the sprayed tow to a pair of squeeze rolls in whose nip it is kneaded through using a defined nip pressure and squeezed off to a fiber finish pickup of 0.7 to 7% by weight of the tow weight,
- heating the squeezed-off moist tow on a heated multiroll arrangement whose roll temperature is not more than 125° C. in such a way that it leaves the multiroll arrangement with a moisture content of 0.5 to 5% by weight and a temperature of 40° to 80° C.,
- feeding the tow with this moisture content and this temperature to a crimping machine and crimping it.

Preferably the hot heat-set tow at 140° to 190° C. is sprayed with an aqueous fiber finish having a temperature of 20° to 80° C., preferably a temperature of 35° to 65° C.

The sprayed-on amount of fiber finish is preferably 100 to 200% by weight of the saturation amount. It was surprisingly found that the treatment method of the invention affords fiber materials which, on further processing, lead to much less soiling of the processing machines (secondary-spinning, weaving or knitting machines) than crimped fibers which have been produced in a conventional manner. Our studies have shown that the particular way of applying the fiber finish, possibly in combination with the other treatment measures of the invention, has a particular significance in achieving this significant quality advantage: evidently, the sprayed-on excess of fiber finish washes at least part of the oligomer off the filaments of the tow.

Preferably, the sprayed tow is squeezed off to a fiber finish pickup of 1 to 4% by weight of the tow weight.

As described above, the squeezed-off moist tow is heated on a heated multiroll arrangement whose roll temperature preferably does not exceed 105° C.

It is further preferred that the squeezed-off moist tow is heated on the heated multiroll arrangement in such a way that it leaves the multiroll arrangement with a moisture content of 0.7 to 3% by weight and a temperature of 50° to 70° C.

The tows of synthetic filaments subjected to the treatment of the invention are advantageously produced by stretch-drawing a tow of melt-spun filaments at elevated temperature in a known manner.

Particularly preferably, the treatment of the invention takes place within the context and as an integral part of a process for producing a uniformly crimped tow of filaments having a high initial modulus by drawing a tow of malt-spun filaments at elevated temperature in a known manner, heat-setting and stuffer box crimping, wherein the steps of heat-setting and stuffer box crimping are carried out according to the invention.

Such a process likewise forms part of the subject-matter of the present invention.

In a preferred embodiment of the treatment according to the invention, the fiber finish excess running off in the sprayer and in the course of the squeeze-off of the fiber-finished tow is collected. Preferably, the collected fiber-finish excess is regenerated and passed back to the sprayer.

Advantageously, during the regeneration of the fiber-finish excess, care is taken to remove the washed-off oligomer present therein.

A further aspect of the invention is a tow of filaments having improved uniformity of crimp and a high initial modulus, which has been subjected to a treatment, and in particular a tow which has been obtained by a process for producing a uniformly crimped tow of filaments having a high initial modulus by stretch-drawing a tow of melt-spun filaments at elevated temperature in a known manner, heat-setting and stuffer box crimping, wherein the steps of heat-setting and stuffer box crimping are carried out according to the invention.

The process of the invention makes it possible to produce a tow of filaments having improved uniformity of crimp and a high initial modulus, the uniformity of crimp and initial modulus being characterized by a coefficient of variation of below 6.5%, preferably below 6.0% for the crimp arc number and of below 7.0%, preferably below 6.5%, for the $T_{10}$ value.

The crimp arc number is measured by counting the number of crimp arcs of a representative number of crimped filaments of the tow under a load of 0.002 g/dtex and standardizing the number of crimps to 1 cm of the crimped filament bearing such a load.

The $T_{10}$ value is determined from the stress-strain diagram of the filaments treated according to the invention by determining the load in cN/dtex required to achieve an extension of 10%.

The coefficients of variation V[%] for the crimp arc number and the $T_{10}$ values are determined from n (advantageously at least 5) independent measurements of these values according to the formula:

$$V[\%] = \frac{s}{\bar{x}} \cdot 100$$

where $\bar{x}$ is the mean crimp arc number or $T_{10}$ value and s is the standard deviation.

The example which follows illustrates the tow treatment of the invention.

EXAMPLE

A tow of synthetic filaments (tow 1) having a total linear density of about 1.45 million dtex (1.3 dtex per filament) is hauled out of collection cans via a septet (zeroth septet), impregnated with a fiber finish in a fiber-finish applicator and passed to a further septet (first septet) which functions as delivery system for the drawing unit. Upstream of the first septet, excess fiber finish is removed by a pair of squeeze rolls. On leaving the delivery system the tow passes through a steam box where it is subjected to saturated steam and through the following, heated septet (2nd septet), which functions as a stretch unit, where it is stretch-drawn and dried. This stretch-drawing stage may, if necessary, be followed by a second stretch-drawing stage (afterstretch).

The stretch-drawn tow thus obtained from the 2nd septet (or the afterstretch stage) is subjected to the treatment of the invention as follows:

The tow is passed to a further septet (3rd septet) whose godets have a temperature of 168° C. On passing through this septet the tow assumes a temperature of about 160° C. and becomes set in the process. The set, hot tow at 160° C. emerging from the 3rd septet is sprayed with warm, aqueous fiber finish at 80° C., and the tow cools down in shocklike manner. The amount of fiber finish sprayed on is determined so that it corresponds to 150% of the saturation amount.

The excess of fiber finish running off the tow is advantageously collected in a trough. The tow saturated with fiber finish passes through a further pair of squeeze is rolls, where the tow is squeezed off to a fiber finish pickup of about 2% (and the squeezed-off fiber finish is advantageously likewise collected), and from there to a fourth septet whose rolls are heated so that the tow leaving the septet has a temperature of about 60° C. and a moisture content of about 1%. The tow thus conditioned is immediately passed to a stuffer box crimping machine. The extraordinarily uniformly crimped tow leaves the crimp box with a temperature of about 63° C. and a moisture content of about 0.87%.

A tow of synthetic filaments (tow 2) having a total linear density of about 1.45 million dtex and a filament linear density of about 1.7 dtex is crimped in a similar manner.

For comparison, the same tows are crimped by the conventional process, i.e. without the treatment of the invention between setting and crimping.

The crimp arc number and the $T_{10}$ value are measured according to the above-described directions on 25 filament samples from the two tows and used to calculate the coefficient of variation. The results obtained are shown in the following table:

TABLE

| | Process of invention | | Conventional process | |
|---|---|---|---|---|
| | Tow 1 | Tow 2 | Tow 1 | Tow 2 |
| Crimp arcs [$cm^{-1}$] | 6.0 | 6.0 | 5.5 | 5.2 |
| Coefficient of variation [%] | 6.1 | 4.8 | 7.3 | 6.7 |
| $T_{10}$ value [cN/tex] | 40.0 | 39.6 | 35.4 | 37.6 |
| Coefficient of variation [%] | 6.3 | 5.4 | 11.1 | 7.5 |

The comparison of the coefficients of variation for the crimp arc number shows that, despite a slightly increased number of arcs per cm (desired effect), the coefficients of variation have decreased in the process of the invention; that is, the scatter in the number of crimps per unit length has been reduced.

A comparison of the coefficients of variation for the $T_{10}$ value shows that, despite a slightly increased modulus of elasticity (desired effect), the coefficients of variation have decreased in the process of the invention; that is, the scatter in the modulus of elasticity has been reduced.

What is claimed is:

1. A tow of filaments having a crimp arc number, a $T_{10}$ value, improved uniformity of crimp and a high initial modulus, characterized by a coefficient of variation of below 6.5% for the crimp arc number and a coefficient of variation of below 7.0% for the $T_{10}$ value.

* * * * *

UNITED STATES PATENT AND TRADEMARK OFFICE

CERTIFICATE OF CORRECTION

PATENT NO. : 5,804,303

DATED : September 8, 1998

INVENTOR(S) : Jürgen Lorenz, et al

It is certified that error appears in the above-identified patent and that said Letters Patent is hereby corrected as shown below:

IN THE ABSTRACT, line 13, "1000°" should read -- 100° --.

Column 3, line 11, "malt-spun" should read -- melt-spun --.

Column 4, line 25, delete "is ".

Signed and Sealed this

Twenty-second Day of December, 1998

*Attest:*

Bruce Lehman

BRUCE LEHMAN

*Attesting Officer*

*Commissioner of Patents and Trademarks*